US011311132B2

(12) United States Patent
Eivaz

(10) Patent No.: US 11,311,132 B2
(45) Date of Patent: Apr. 26, 2022

(54) PACKAGE-RECEIVING CONTAINER

(71) Applicant: Ahmad Eivaz, San Marcos, CA (US)

(72) Inventor: Ahmad Eivaz, San Marcos, CA (US)

( * ) Notice: Subject to any disclaimer, the term of this patent is extended or adjusted under 35 U.S.C. 154(b) by 0 days.

(21) Appl. No.: 16/593,755

(22) Filed: Oct. 4, 2019

(65) Prior Publication Data

US 2020/0107663 A1 Apr. 9, 2020

Related U.S. Application Data

(60) Provisional application No. 62/741,487, filed on Oct. 4, 2018.

(51) Int. Cl.
*A47G 29/14* (2006.01)
*A47G 29/20* (2006.01)

(52) U.S. Cl.
CPC ..... *A47G 29/141* (2013.01); *A47G 29/20* (2013.01); *A47G 2029/144* (2013.01); *A47G 2029/145* (2013.01); *A47G 2029/149* (2013.01)

(58) Field of Classification Search
CPC ..... A47G 29/124; A47G 29/16; A47G 29/20; A47G 29/141; A47G 2029/144; A47G 2029/145; A47G 2029/148; A47G 2029/149; B65D 7/26; B65D 7/24; B65D 21/086; B65D 11/1826; B65D 11/184; B65D 11/1853
USPC ..... 232/17, 19, 34–36, 38, 45, 22; 340/569; 220/6
See application file for complete search history.

(56) References Cited

U.S. PATENT DOCUMENTS 335,119 A * 2/1886 Flint ..... B65D 7/26 220/6
1,673,769 A * 6/1928 Graham ..... G07C 13/02 220/6
1,915,980 A * 6/1933 Craft ..... A47G 29/12 232/19
2,229,646 A * 1/1941 Firestone ..... A47G 29/1223 220/6
2,456,479 A * 12/1948 Antil ..... A47G 29/14 220/6
2,868,406 A * 1/1959 Kookogey ..... B65D 7/26 220/7
2,914,210 A * 11/1959 Paston ..... B65D 9/14 220/6
3,195,506 A * 7/1965 Beard ..... A01K 1/0245 119/496
5,064,068 A * 11/1991 Sheng ..... B65D 11/1826 220/6
5,624,071 A * 4/1997 Sosan ..... A47G 29/20 232/1 B (Continued)

*Primary Examiner* — William L Miller
(74) *Attorney, Agent, or Firm* — CP Law Group PC; Cy Bates

(57) ABSTRACT

A package-receiving container includes: a receptacle portion; a lid portion coupled to the receptacle portion and configured to control access to a receptacle volume associated with the receptacle portion; and a tether coupled to the receptacle portion, the lid portion, or a combination thereof; wherein: the tether is configured to engage at least one of: a door and a door jamb; and the package-receiving container is configured to receive a package within the receptacle volume. The package-receiving container may further include electronics features for smart home integration.

18 Claims, 4 Drawing Sheets

(56) References Cited

U.S. PATENT DOCUMENTS 6,155,715 A * 12/2000 Lake ..... A47G 29/20 150/102
6,426,699 B1 * 7/2002 Porter ..... A47F 10/00 221/2
6,540,134 B1 * 4/2003 Rasche ..... A47G 29/14 220/4.28
7,083,061 B2 * 8/2006 Spindel ..... B65D 11/1826 217/15
7,510,097 B2 * 3/2009 Spindel ..... B65D 11/1826 217/15
9,364,112 B2 * 6/2016 Sundaresan ..... A47G 29/20
9,596,952 B2 * 3/2017 Mencel ..... A47G 29/141
10,083,561 B2 * 9/2018 Sundaresan ..... A47G 29/20
10,292,519 B1 * 5/2019 Sutton ..... A47G 29/1209
10,299,617 B1 * 5/2019 Castellanos ..... A47G 29/141
10,321,780 B1 * 6/2019 James ..... A47G 29/141
10,383,471 B1 * 8/2019 Barnes ..... A47G 29/20
10,537,196 B1 * 1/2020 MacPherson ..... A47G 29/20
10,537,197 B2 * 1/2020 Hopp ..... A47G 29/20
10,696,453 B2 * 6/2020 Sena ..... A47G 29/141
10,743,692 B1 * 8/2020 Mackey ..... A47G 29/1216
10,743,694 B2 * 8/2020 Raphael ..... A47G 29/141
10,743,695 B1 * 8/2020 Altmaier ..... A47G 29/20
10,772,451 B2 * 9/2020 Vernal Silva ..... A47G 29/141
11,197,566 B2 * 12/2021 Aresu ..... A47G 29/124
11,246,443 B2 * 2/2022 Lin ..... A47G 29/141
2003/0006275 A1 * 1/2003 Gray ..... A47G 29/141 232/19
2006/0261061 A1 * 11/2006 Spindel ..... B65D 11/22 220/6
2012/0269461 A1 * 10/2012 Proctor ..... G09F 23/00 383/64
2013/0077896 A1 * 3/2013 Wiley ..... A47G 29/20 383/86.2
2014/0000322 A1 * 1/2014 Williams ..... E05B 73/0011 70/18
2014/0048369 A1 * 2/2014 Zhu ..... A45C 7/0036 190/21
2016/0068306 A1 * 3/2016 Heinz ..... B65D 81/02 220/560.01
2017/0127868 A1 * 5/2017 Adewuyi ..... A47G 29/141
2017/0188737 A1 * 7/2017 Hippert ..... A47G 29/20
2018/0070753 A1 * 3/2018 Eveloff ..... A47G 29/141
2018/0222625 A1 * 8/2018 Perella ..... B65D 9/14
2018/0228310 A1 * 8/2018 Enobakhare ..... A47G 29/1207
2018/0228311 A1 * 8/2018 Bloom ..... B64C 39/024
2018/0296016 A1 * 10/2018 Teoh ..... A47G 29/20
2019/0038062 A1 * 2/2019 Sundaresan ..... A47G 29/1225
2019/0218828 A1 * 7/2019 Ruth ..... E05B 47/0002
2019/0225375 A1 * 7/2019 Sena ..... A47G 29/141
2019/0231104 A1 * 8/2019 Dunkelberger ..... A47G 29/124
2019/0320836 A1 * 10/2019 Guanch ..... A47G 29/20
2019/0350398 A1 * 11/2019 Raphael ..... A47G 29/141
2020/0015616 A1 * 1/2020 Sankaran ..... A47G 29/20
2020/0060460 A1 * 2/2020 Farrar ..... A47G 29/141
2020/0323377 A1 * 10/2020 O'Connor ..... A47G 29/20
2020/0380465 A1 * 12/2020 Newcomb ..... A47G 29/141
2020/0397172 A1 * 12/2020 Kennett ..... E05B 65/52
2021/0127880 A1 * 5/2021 Raphael ..... A47G 29/141

* cited by examiner

PACKAGE-RECEIVING CONTAINER

CROSS-REFERENCE TO RELATED APPLICATIONS

This application claims benefit of U.S. Provisional Application Ser. No. 62/741,487, filed Oct. 4, 2018; the entire contents of which are hereby incorporated by reference.

BACKGROUND

Field of the Invention

The invention relates to containers for receiving package-deliveries; and more particularly, to a package-receiving container for securely receiving and holding a received package, deterring theft of a received package, and/or protecting a received package from theft.

Description of the Related Art

As internet commerce ("e-commerce") continues to grow, individual and business consumers are purchasing more products online, and shipping couriers are delivering increasingly more packages to homes and businesses. These deliveries generally occur during the day, at times when many individuals are away from their home and unable to personally accept packages as they are delivered. In addition, small businesses often step away momentarily and at times may not be present to receive packages. As such, many packages are left by the courier at the purchaser's doorstep or a similar location.

Recently, criminals have taken notice of the vulnerabilities of these unprotected packages and occurrences of theft are becoming an increasing reality.

While others have contemplated storage lockers for receiving packages at a home or commercial building, none have been widely implemented because these lockers are generally bulky, aesthetically displeasing, and require permanent installation. Additionally, many community associations disallow the installation of such lockers for these and other reasons.

Indeed, solutions have been proposed, such as electronic controlled-access, whereby a receiver of a package can be notified electronically of the arrival of a courier, and using a software application ("app") executed by a computerized device, such as a mobile tablet or smart phone, the receiver can authorize access to allow the courier to deliver the package inside a dwelling by unlocking an access door. Examples of this solution include AMAZON IN-HOME DELIVERY, AMAZON KEY, and RING. While this solution works for some, many individuals lack the required trust to allow unknown individuals into the dwelling, thereby resulting in slow or negligible adaption of electronic controlled access for package receiving.

Other solutions include the use of package lockers, post office boxes, or other remote receiving options for receiving packages. However, many individuals find it inconvenient to travel to remote receiving options for pickup, Additionally, some packages are too large to be received in many remote receiving options, and available space is often limited.

There remains a long felt need for an improvement which addresses these and other problems that would be recognized by one with skill in the art.

SUMMARY

A package-receiving container is disclosed, the package-receiving container includes: a receptacle portion; a lid portion coupled to the receptacle portion and configured to control access to a receptacle volume associated with the receptacle portion; and a tether coupled to the receptacle portion, the lid portion, or a combination thereof; wherein: the tether is configured to engage at least one of: a door and a door jamb; and the package-receiving container is configured to receive a package within the receptacle volume.

The package-receiving container may further include: a control board, the control board comprising an electronic control circuit and componentry configured to execute commands for locking and unlocking the lid portion for controlling access to the receptacle volume.

The package-receiving container may further include: a camera, the camera being coupled to the control board, wherein the camera is adapted to capture one or more images of an environment adjacent to the package-receiving container. In some embodiments, the control board can be configured to transmit the one or more images over a wireless network connection, store the one or more images in a computer-readable media, or a combination thereof. In some embodiments, the one or more images captured by the camera may comprise a video.

In some embodiments, the receptacle portion may comprise a base, and a body coupled to the base, wherein the body is disposed between each of the base and the lid portion.

In some embodiments, the body may comprise a cut-resistant fabric; the cut-resistant fabric may comprise Cut-Tex®. In other embodiments, the body comprises a collapsible assembly of integrated rigid panels. In some embodiment, the package-receiving container may comprise a combination of fabric and plastic components, or a combination of these and other materials suitable for manufacturing a protective storage unit such as the package-receiving container as would be understood by one with skill in the art.

The package-receiving container may further comprise: a motion detector, the motion detector being coupled to the control board, wherein upon detecting motion at the motion detector, the electronic control circuit is configured to initiate a communication with a user over a wireless network connection.

The package-receiving container may further comprise: a motion detector, the motion detector being coupled to the control board, wherein upon detecting motion at the motion detector, the electronic control circuit is configured to: activate the camera for acquiring the one or more images, initiate a communication with a user over the wireless network connection, or a combination thereof.

The package-receiving container may further comprise: a communication system, the communication system being coupled to the control board, wherein the communication system is configured to provide one-way or two-way communication between a remote user and another being in proximity to the package-receiving container.

In some embodiments, the communication system may comprise: a microphone, a camera, a display screen, one or more speakers, or a combination thereof.

The package-receiving container may further comprise: a locking system for locking and unlocking the lid portion with receptacle portion for controlling access to the receptacle volume.

In some embodiments, the locking system may comprise a keyed locking system; for example, and the locking system may comprise a mechanically keyed locking system.

In some embodiments, the locking system may comprise: a keypad, a biometric sensor, or a combination thereof.

The package-receiving container may further comprise: a power cord for powering the control board and up to a plurality of components electronically coupled thereto. The power cord can be embedded in, or attached to, the tether.

The package-receiving container may further comprise: a battery power source.

DETAILED DESCRIPTION

Figure 1:
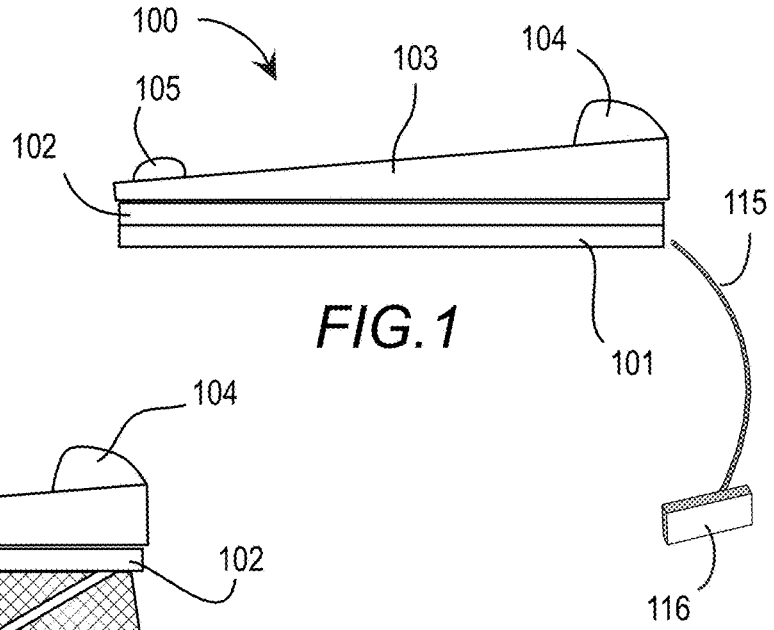
FIGS. 1-3 show a package-receiving container in accordance with a first illustrated embodiment.

A package-receiving container for securely receiving packages from one or more couriers is disclosed.

In one embodiment, a package-receiving container is configured for temporary installation at the residential or commercial property of an e-commerce purchaser. The temporary installation enables use of the package-receiving container when needed, but the assembly can be uninstalled and stored away when not required. In this regard, a permanent and aesthetically displeasing storage locker is not required since the unit disclosed herein may be uninstalled at any time.

Thus, the package-receiving container may provide a security deterrent to deter theft of packages, protect packages from such theft, or to further protect packages from environmental factors such as: weather, water, animals, and the like.

Security Tether

For purposes herein, the terms "security leash", "leash", "security tether", and "tether" may be used interchangeably.

To support temporary installation and to concurrently maintain enough security of the package-receiving container and contents thereof, the package-receiving container can comprise a tether configured to attach to a structural feature of a residential or commercial property of the e-commerce purchaser.

In one embodiment, the tether comprises a cable attached to the package-receiving container at a first end of the cable, and the cable is further configured to engage a door and door frame at a second end opposite the first end of the cable. The cable can be fabricate using known techniques for security-related cables, including the use of metal cables, single-filament or rope, and the like. In one example, the leash may comprise a plate, ball or other object at a terminal end such that a portion of the cable is configured to fit between the door and door jamb or frame whereas the plate, ball or other object has sufficient volume to tether the cable to the door system of the property. In this regard, the package-receiving container is securely attached to the structure of the property in a temporary fashion.

In another embodiment (not shown), the tether may comprise an L-shaped channel, or U-shaped channel, sufficient to engage the side of a door and fit within a gap between the door and door frame of the door system.

In yet another embodiment, the tether may comprise any lockable mounting feature as would be appreciated by one with skill in the art, such lockable mounting feature including: a mounting plate for affixing to a beam, concrete, or other secure feature; and a corresponding engagement element, wherein the engagement element is capable of removably locking to the mounting plate until a user intends to release the engagement with a key or similar locking element. Thus, while the tether may be preferred to anchor at a door and door frame of a door system, the tether may be provided in another implementation incorporating a locking mounting plate.

Collapsibility/Storage

When not required for use, the package-receiving container can be collapsed for storage.

In one embodiment, the package-receiving container comprises a base, a lid portion, and a body configured therebetween. The body may comprise a cut-resistant fabric, such as a metallic mesh, or other fabric material, or a combination thereof, wherein the body is configured to collapse between the base and the lid portion.

In another embodiment, the package-receiving container comprises a base, a lid portion, and a foldable body. The foldable body may comprise a plurality of rigid plastic, composite, wood or metal material panels or portions that are designed to fold for collapsibility.

Electronic Features

The package-receiving container further comprises electronic features for smart-home integration. For example, the package-receiving container may comprise a camera, such as a WIFI- or Bluetooth-enabled camera; a motion detector, such as a passive infrared (PIR) detector; one- or two-way voice capability (communication system), such as integrating a microphone and/or speaker communication system; a lock pad, such as a biometric or keypad locking system for controlling access into an interior-volume of the package-receiving container; a power cord and/or battery power source. The electronic features are not limited to these examples, and one with skill in the art will appreciate the myriad of select features available for integration with the package-receiving container. Such myriad of select features may be implemented in accordance with known techniques.

Temporary Installation and Use of the Package-Receiving Container

In order to use the package-receiving container, a user generally unfolds and expands the package-receiving container, and places the package-receiving container outside in an expanded state. The terminal end of the security tether is placed inside the building with the cable extending between a door and door jamb of a door system, and the door is closed and locked such that the package-receiving container becomes secured to the door system. As mentioned above, alternative techniques, such as use of a mounting plate, may be similarly implemented. Optionally and preferably, the user plugs a power cord into an outlet within the interior of the building, or alternatively a battery source may be utilized for powering the package-receiving container. The package-receiving container is now temporarily-installed and ready for use.

In some embodiments, the battery source is provided as a backup power source and is only used in the event the primary power source (power cord) is disconnected or becomes inactive.

The power cord may be integrated with the security tether for extending into the interior of the respective residential or commercial property structure.

With the package-receiving unit temporarily-installed as described above, a courier may access the interior-volume of the package-receiving container using the biometric or keypad locking system. For purposes herein, the terms "interior-volume" and "receptacle volume" may be used interchangeably. For example, and not limitation, a lid of the package-receiving container may be opened upon entering a passcode at the keypad of the package-receiving container. In this regard, the courier can approach the package-receiving container and a motion sensor can detect presence of the courier. Upon detection of the courier, the ecommerce purchaser can be notified. In one embodiment, the package-receiving container detects the courier with a motion sensor and sends a notification to the ecommerce purchaser, for example via SMS (short message service, aka: text message) or email notification. A specialized software application ("app") may be provided to the ecommerce purchaser, such as by installing such an app with the purchaser's phone, and the app may be integrated with the package-receiving container to form a smart system for receiving and sharing packages or other items. Upon receiving the notification generated and sent from the package-receiving container, the ecommerce purchaser can either share a passcode, for example via a one- or two-way communication system integrated with the package-receiving container, or the ecommerce purchaser may unlock the package-receiving container remotely, allowing the lid portion of the package-receiving container to open by unlocking a locking system of the package-receiving container. Once the lid portion is opened (electronic latch disengaged), the courier may place a package within the package-receiving container (or other invitee may access the inside of the container to exchange objects).

Optionally, the package-receiving container may be programmed to unlock using biometrics, for example with one or more user(s) fingerprints being electronically stored. In one embodiment, the owner's biometrics can be stored for easy access, and/or the biometrics of a neighbor, family member, or friend can be stored for providing access. In this regard, the package-receiving container is not required to be exclusively used for ecommerce purchases and courier deliveries, but may also be used for sharing items with select individuals.

The lid can be configured to automatically lock upon closing the lid, or a timed delay, such as about five to thirty seconds, or up to any desired time interval, may be implemented.

Conventional servo-actuated, keyed, or other locking mechanisms known to one having skill in the art may be utilized for locking the lid portion of the package-receiving container.

As mentioned above, the package-receiving container may comprise a camera. The camera is preferably configured to connect with a Wi-Fi router or access point of the user's wireless access network, though in some embodiments the camera may connect to the user's network via BLUETOOTH or other wireless connection technology, including cellular technologies. The camera is generally configured to point in a direction for capturing an image of any individual attempting to access the interior-volume (receptacle volume) of the package-receiving container. In one embodiment, the camera is configured to communicate an image or video (series of images) to the ecommerce purchaser (remote user), for example via SMS (text message), email, or via the app installed in the remote user's phone, tablet pc, laptop or desktop, or any combination thereof.

In some embodiments, the electronic control circuit of the control board may be configured to connect with third-party software applications, such as RING or other third-party apps.

In some embodiments, the camera may be used to capture and store images or video via the cloud (online storage). In the event of theft, or attempted theft, the camera may be configured to provide images or video useful for identifying the perpetrator of a crime. In other embodiments, the images or video may be stored locally within memory coupled to the electronic control circuit of the control board, or otherwise as may be appreciated by one with skill in the art.

The camera and/or one- or two-way communication system are generally activated or prompted upon detection of an individual in proximity to the package-receiving container. This can be accomplished with passive infrared sensors, proximity sensors, or the like. Image(s), video(s), audio, or any combination thereof, or notice of availability to access any thereof via cloud or otherwise, is generally communicated to the remote user via SMS, email, or the software app. Other techniques can be implemented for notifying the user of the presence of a person, such as a courier, in accordance with the knowledge in the art.

In some embodiments, the package-receiving container may comprise a button positioned on an exterior surface of the container, the button being configured to call the user for initiating one- or two-way communication between a courier and the user.

When use of the package-receiving container is no longer required, the package-receiving container may be collapsed and stored away as discussed above.

In another embodiment, a mounting plate can be secured to a building or ground, the mounting plate being configured as a low-profile anchor point for receiving the tether of the package-receiving container. In this regard, instead of coupling the package-receiving container to a door, the package-receiving container may be configured for mounting to the mounting plate. Because the mounting plate is low-profile, some users may find the mounting plate to be non-invasive and aesthetically acceptable for permanent installation, for example, using lag bolts or other mounting fasteners as would be recognized by one having skill in the art. This embodiment may be preferred, especially where a courier drop is located at the end of a property, for example, at the end of a long and gated driveway or at a street-side location of a property. Select features, such as electronic features, may be implemented where feasible. For example, if Wi-Fi connection is unavailable, the camera may be configured to store images within memory coupled to the control circuit. Other features will be appreciated by one having skill in the art upon review of this disclosure.

First Illustrated Embodiment

Figure 2:
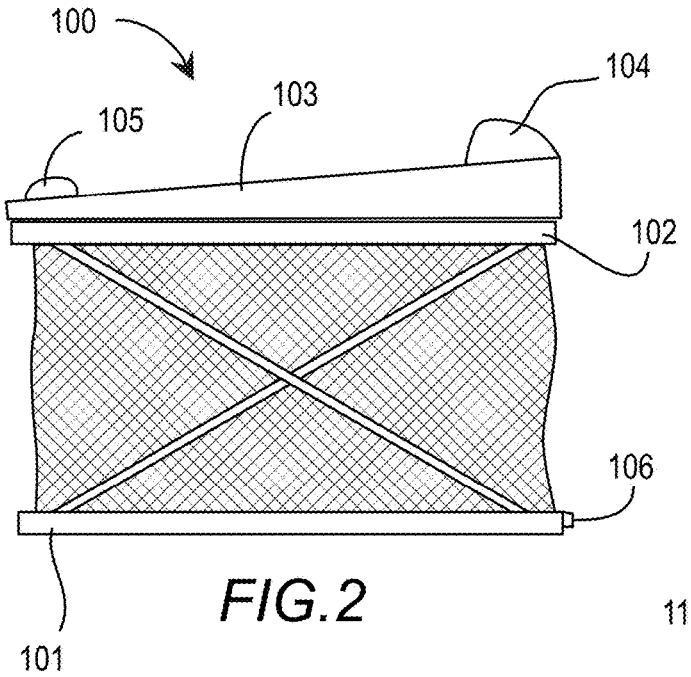
Figure 3:
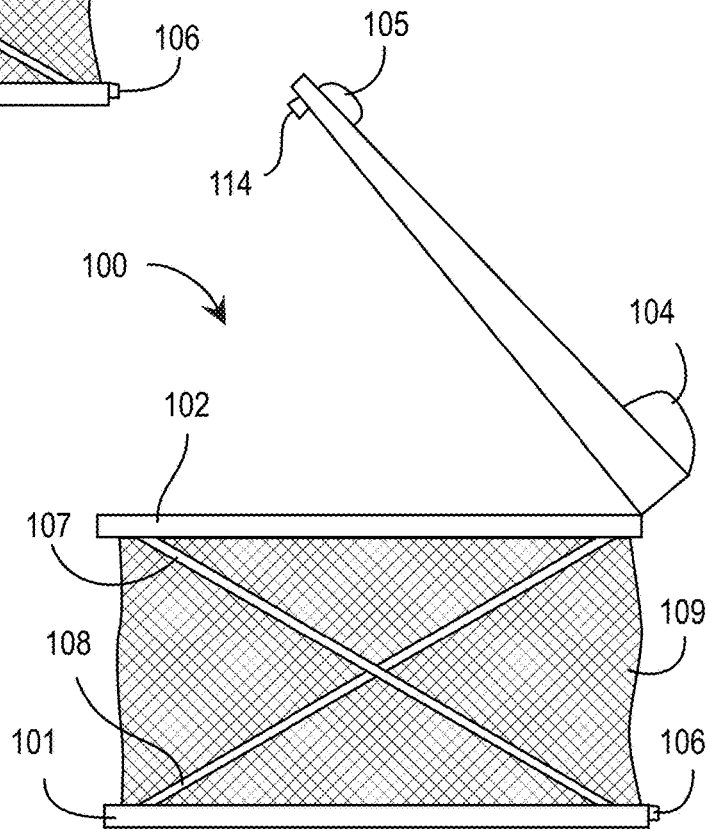
Figure 4:
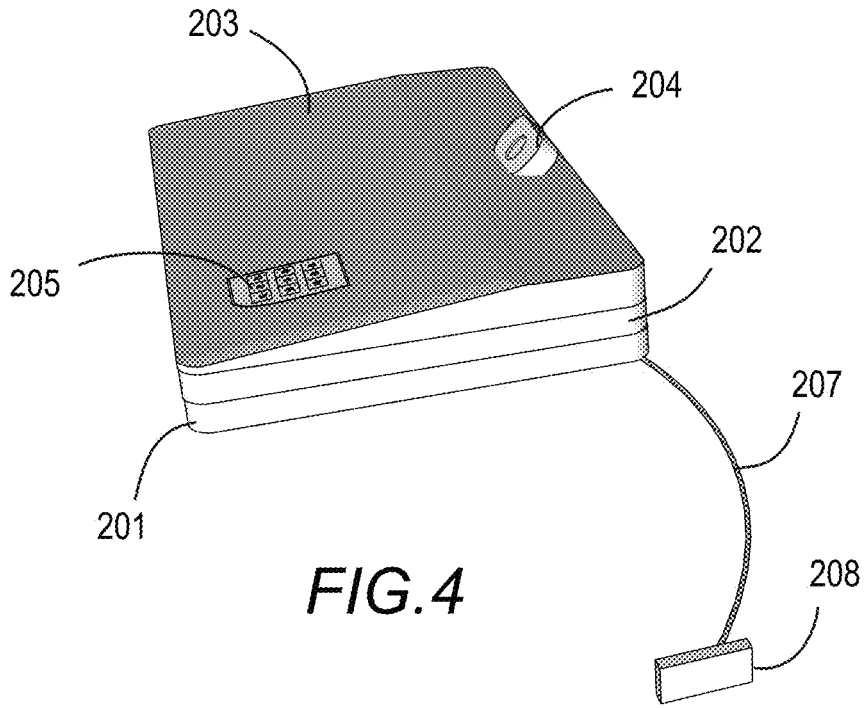
FIGS. 4-8 show a package-receiving container in accordance with a second illustrated embodiment.

In a first illustrated embodiment, as shown in FIGS. 1-3, a package-receiving container is configurable between a first collapsed state (FIG. 1), a second expanded state with closed lid (FIG. 2), and a second expanded state with open lid (FIG. 3).

The package-receiving container 100 comprises a base 101, an upper annular portion 102, and a body extending therebetween, here the body comprises a metal mesh 109 extending between the base and upper annular portion. As noted above, the body may comprise other cut-resistant materials or fabrics. Slidable crossbars 107; 108 are configured to slide about the base and upper annular portion for expanding and collapsing the mesh body. Lid portion 103 is hingedly connected to the upper annular portion, and capable of opening upon release of locking mechanism 114. The lid portion is configured with a camera 104, which may further include embedded electrical features such as a motion detector or passive infrared (PIR) sensor, microphone, speaker, and other useful componentry as described herein or as recognized as having benefit by one with skill in the art. The lid portion further includes keypad locking system 105 which is configured to release locking mechanism 114. The base is shown including a mount 106 for attaching the security tether 115. Optionally, and preferably, the package-receiving container includes a power cord implemented with the security tether 115. At a terminal end of security tether 115 is disposed a security plate 116 (though other similar features may be implemented).

Second Illustrated Embodiment

Figure 5:
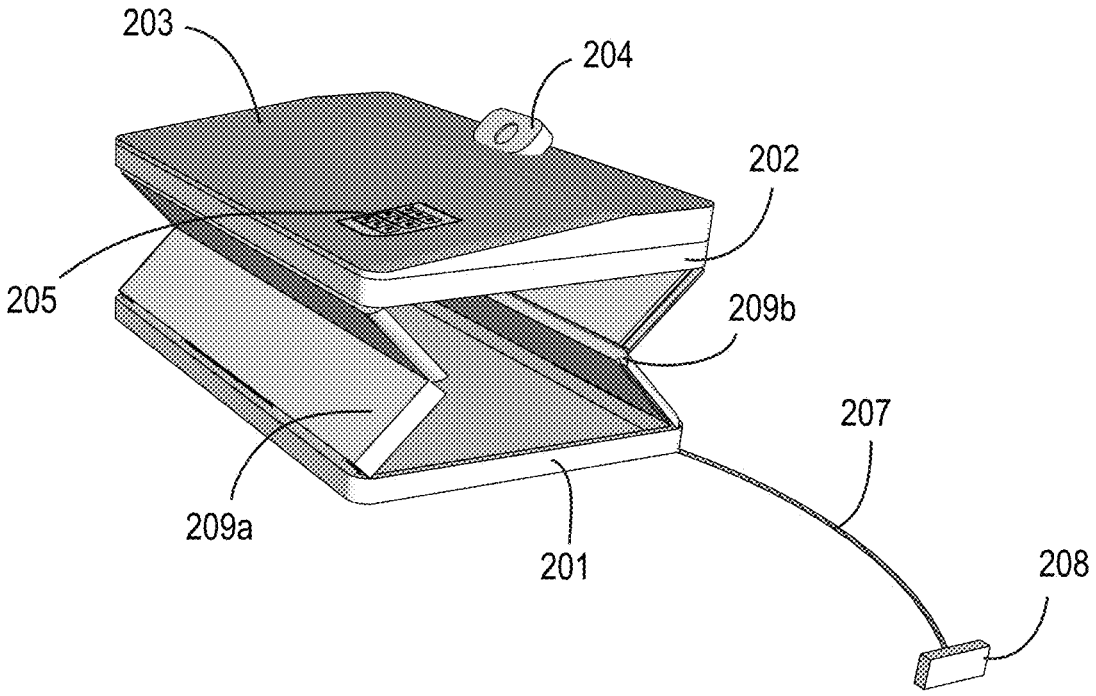
Figure 6:
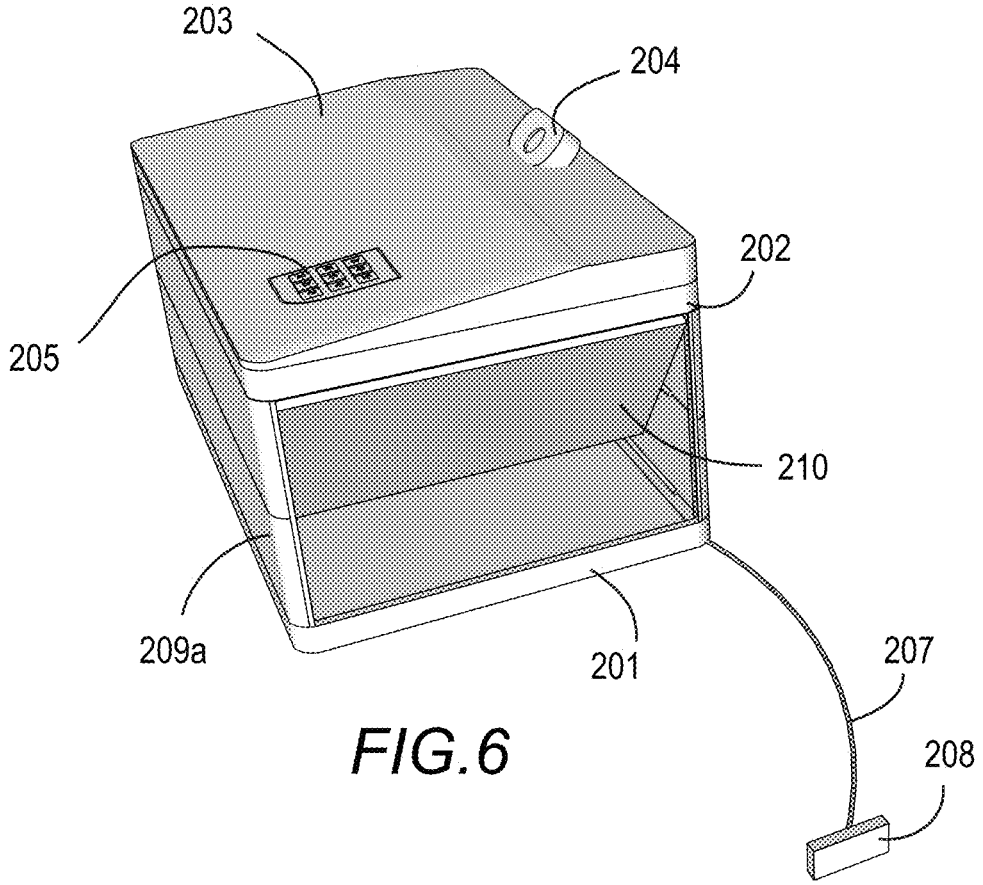
Figure 7:
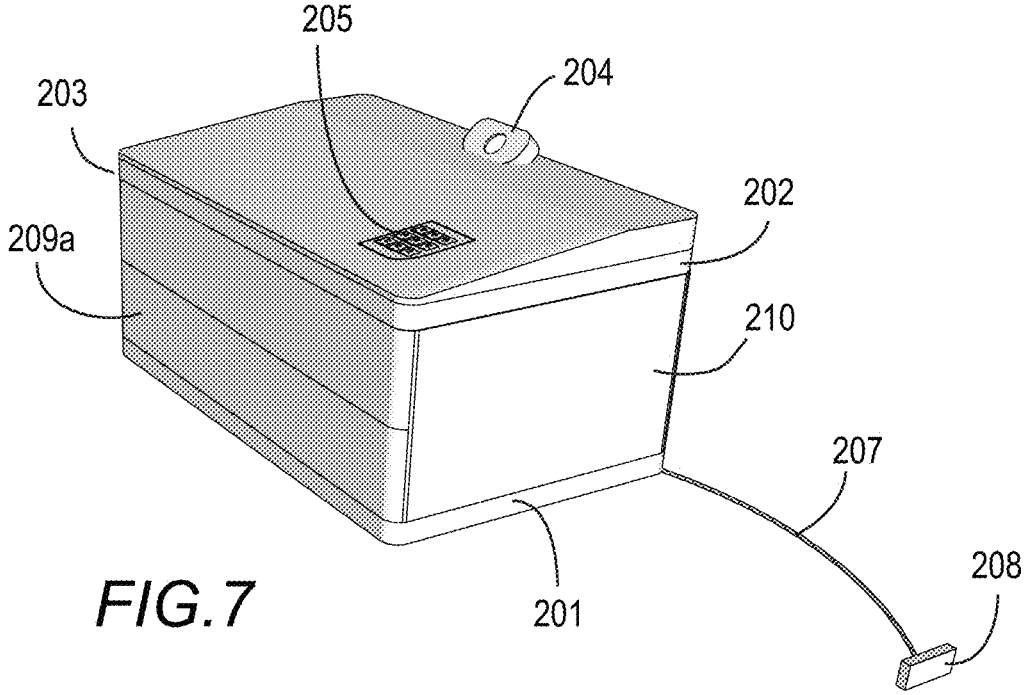
Figure 8:
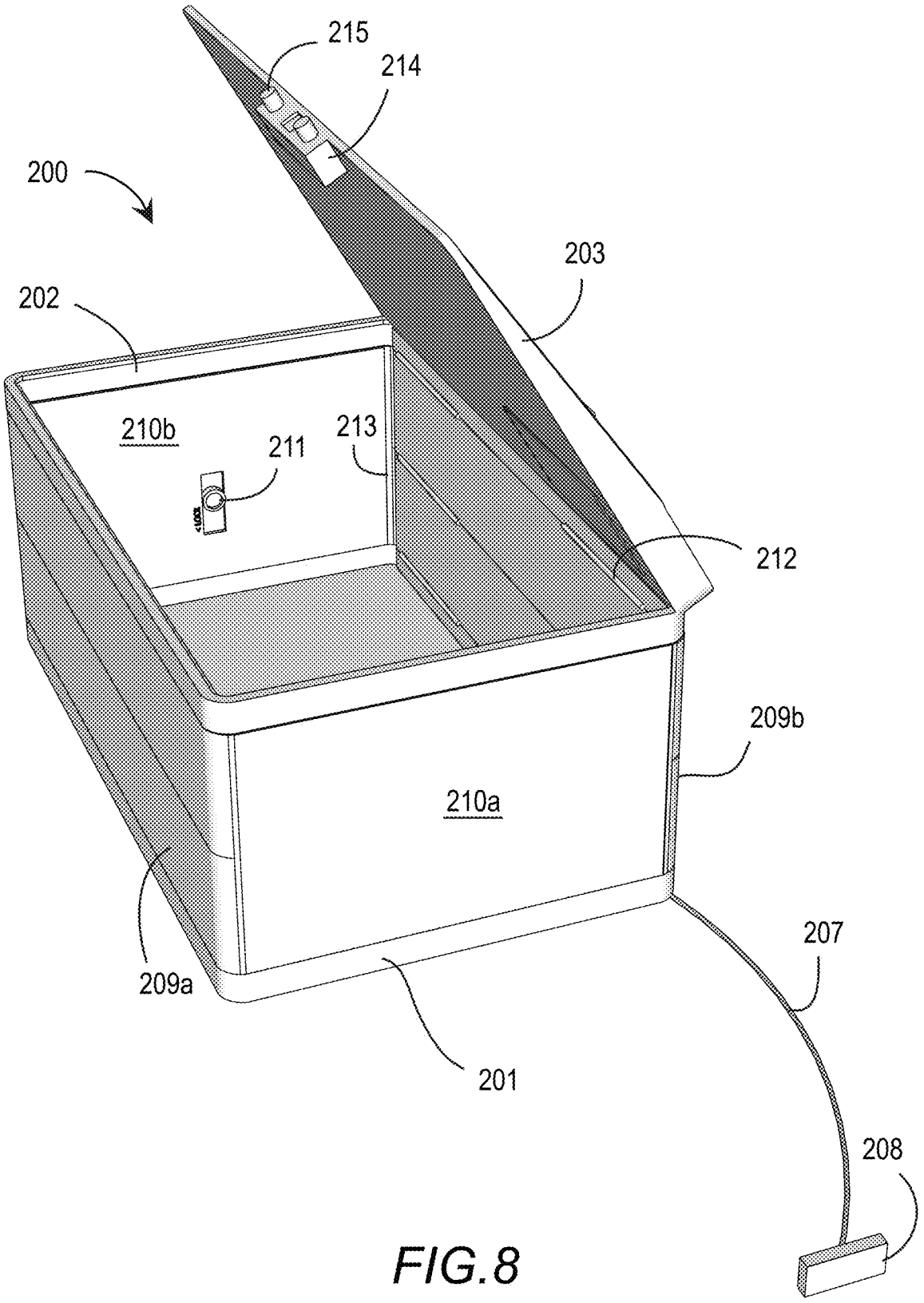

In a second illustrated embodiment, as shown in FIGS. 4-8, a package-receiving container is configurable between a first collapsed state (FIG. 4), a second expanded state with closed lid (FIG. 7), and a second expanded state with open lid (FIG. 8). FIGS. 5-6 show the package-receiving assembly in various configurations between the collapsed and expanded states.

In the second embodiment, the package-receiving container comprises: a base 201, a lid assembly 202; 203, and a body extending between the base and lid assembly. The lid assembly comprises a first lid portion 202 and a second lid portion 203 configured to open about the first lid portion for providing access into an interior volume of the package-receiving container. The first lid portion 202 may comprise an annular ring-like shape. The package-receiving container further comprises a camera 204 and one or more electronic features as described herein, and a keypad locking system 205 configured to release a locking mechanism 214.

The package-receiving container is configured to attach to a security tether 207 and security plate 208. In a preferred embodiment, a power cord is embedded within the security tether.

The body of the package-receiving container is shown with rigid body sub-panels, including first and second bifurcating sub-panels, and first and second gating sub-panels. Here, the bifurcating sub-panels are shown (FIG. 5) as folding in half at a hinge of the bifurcating sub-panels 209*a*; 209*b*. In addition, gating sub-panel 210 is shown (FIG. 6) configured to fold about the first lid portion 202. The opposite gating sub-panel is not visible from FIG. 5; however, it is a mirror opposite of sub-panel 210 and located on the opposite side. Once the bifurcating sub-panels are aligned in parallel planes and the package-receiving container is configured in the expanded state, the gating sub-panels are folded down (or in a reverse embodiment, they may fold up). Flanges 213 are disposed at each corner and are used to provide locking relation between gating and bifurcating sub-panels when the package-receiving container is configured in the expanded state. In addition, slide-locks 211 are embedded in the gating sub-panels and configured to slide downwardly into corresponding slots for locking the gating sub-panels into position with the package-receiving container when configured in the expanded state.

Locking mechanism 214 is shown including locking pins 215, which are actuated to translate into a locked position (pins extend into corresponding holes) and unlocked position (pins retracted).

In some embodiments (not shown), the package receiving container may further comprise one or more security cables configured to extend between the top of the lid and bottom of the lid, or top of the lid and the base of the receptacle, for preventing unwanted access to the package-receiving container.

Unless explicitly defined, or appreciated from the context of this disclosure, all terms used herein are otherwise intended to be defined in accordance with their plain and ordinary meaning as would be understood by one having skill in the art.

While various details, features, and combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

What is claimed is:

1. A package-receiving container, comprising:

a receptacle portion, the receptacle portion having a base and a body coupled to the base; and a lid portion coupled to the body and configured to control access to a receptacle volume associated with the receptacle portion;

wherein:

the package-receiving container is configured to receive a package within the receptacle volume; and further wherein:

the body comprises a plurality of gating sub-panels, wherein each of the plurality of gating sub-panels is configured to fold about the lid portion or the base, the plurality of gating sub-panels further configured to place the package-receiving container into an expanded state, and wherein the plurality of gating sub-panels further comprises a slide-lock embedded on each of the plurality of gating-sub-panels, wherein each of the slide-locks is configured to slide downwardly for locking the plurality of gating sub-panels with the package-receiving container when configured in the expanded state.

2. The package-receiving container of claim 1, further comprising:

a control board, the control board comprising an electronic circuit and componentry configured to execute commands for locking and unlocking the lid portion for controlling access to the receptacle volume.

3. The package-receiving container of claim 2, further comprising:

a camera, the camera being coupled to the control board, wherein the camera is adapted to capture one or more images of an environment adjacent to the package-receiving container.

4. The package-receiving container of claim 3, wherein the control board is configured to transmit the one or more images over a wireless network connection, store the one or more images in a computer-readable media, or a combination thereof.

5. The package-receiving container of claim 3, wherein the one or more images captured by the camera comprises a video.

6. The package-receiving container of claim 2, further comprising: a motion detector, the motion detector being coupled to the control board, wherein upon detecting motion at the motion detector, the control circuit is configured to initiate a communication with a user over a wireless network connection.

7. The package-receiving container of claim 2, further comprising a power cord for powering the control board and up to a plurality of components electronically coupled thereto.

8. The package-receiving container of claim 2, further comprising a battery power source.

9. The package-receiving container of claim 1, further comprising: a locking system for locking and unlocking the lid portion with receptacle portion for controlling access to the receptacle volume.

10. The package-receiving container of claim 1, wherein the gating sub-panels are disposed on opposite sides of the body.

11. The package-receiving container of claim 1, the body further comprising a plurality of bifurcating sub-panels disposed at opposite sides of the body, wherein each of the bifurcating sub-panels is configured to fold in half at a hinge.

12. The package-receiving container of claim 11, the plurality of gating sub-panels further comprising a flange disposed on each of the plurality of gating sub-panels, wherein each of the flanges is configured to provide a locking relating between the plurality of gating sub-panels and the plurality of bifurcating sub-panels.

13. The package-receiving container of claim 1, the package-receiving container further comprising a tether coupled to the receptacle portion, the lid portion, or a combination thereof.

14. The package-receiving container of claim 13, the tether further comprising a plate, wherein the plate is configured to engage at least one of: a door and a door jamb.

15. A package-receiving container, comprising:

a base;

a lid portion;

a body disposed between each of the base and lid portion, the body further comprising:

a first bifurcating sub-panel and a second bifurcating sub-panel opposite the first bifurcating subpanel, wherein the first and second bifurcating sub-panels are configured to fold in half at a hinge, a plurality of gating sub-panels, wherein each of the plurality of gating sub-panels is configured to fold about the lid portion or the base;

wherein:

the plurality of gating sub-panels is configured to place the package-receiving container into an expanded state, and wherein the plurality of gating sub-panels further comprises a slide-lock embedded on each of the plurality of gating-sub-panels, wherein each of the slide-locks is configured to slide downwardly for locking the plurality of gating sub-panels with the package-receiving container when configured in the expanded state.

16. The package-receiving container of claim 15, the package-receiving container further comprising a tether coupled to the receptacle portion, the lid portion, or a combination thereof.

17. The package-receiving container of claim 16, the tether further comprising a plate, wherein the plate is configured to engage at least one of: a door and a door jamb.

18. The package-receiving container of claim 15, the plurality of gating sub-panels further comprising a flange disposed on each of the plurality of gating sub-panels, wherein each of the flanges is configured to provide a locking relating between the plurality of gating sub-panels and the first and second bifurcating sub-panels.

* * * * *